US011105232B2

(12) United States Patent
Nakaya

(10) Patent No.: US 11,105,232 B2
(45) Date of Patent: Aug. 31, 2021

(54) BLOW-BY GAS CONDUIT

(71) Applicant: NIFCO INC., Yokosuka (JP)

(72) Inventor: Hiroyuki Nakaya, Yokosuka (JP)

(73) Assignee: NIFCO INC., Yokosuka (JP)

( * ) Notice: Subject to any disclaimer, the term of this patent is extended or adjusted under 35 U.S.C. 154(b) by 0 days.

(21) Appl. No.: 16/633,714

(22) PCT Filed: Jul. 24, 2018

(86) PCT No.: PCT/JP2018/027640

§ 371 (c)(1),
(2) Date: Jan. 24, 2020

(87) PCT Pub. No.: WO2019/031225

PCT Pub. Date: Feb. 14, 2019

(65) Prior Publication Data

US 2020/0208553 A1 Jul. 2, 2020

(30) Foreign Application Priority Data

Aug. 8, 2017 (JP) ..... JP2017-153193

(51) Int. Cl.
*F01M 13/04* (2006.01)

(52) U.S. Cl.
CPC ..... *F01M 13/04* (2013.01); *F01M 13/0405* (2013.01)

(58) Field of Classification Search
CPC ..... F01M 13/04; F01M 13/0405
See application file for complete search history.

(56) References Cited

U.S. PATENT DOCUMENTS 4,627,406 A * 12/1986 Namiki ..... F02M 25/06 123/573
8,961,636 B2 2/2015 Horiuchi
9,938,937 B2 4/2018 Kobayashi et al.
10,729,998 B2 * 8/2020 Morishita ..... B01D 45/08
(Continued)

FOREIGN PATENT DOCUMENTS

JP S57-81415 U 5/1982
JP S60-84714 U 6/1985
(Continued)

OTHER PUBLICATIONS

PCT/ISA/210, "International Search Report for International Application No. PCT/JP2018/027640," dated Sep. 18, 2018.

*Primary Examiner* — Kevin A Lathers
(74) *Attorney, Agent, or Firm* — Manabu Kanesaka

(57) ABSTRACT

A fluid conduit allowing a fluid to flow therethrough is provided, which can increase airtightness by a partition wall without reducing the accuracy of a size or a shape of an orifice provided in the partition wall. A partition wall 10 of a fluid conduit 1 is formed by joining an upper-side partition wall portion 11 and a lower-side partition wall portion 12 by welding. The lower-side partition wall portion 12 includes a joint-side portion 13 and an orifice-side portion (a wall portion 31), and while providing a joint portion 19 to the upper-side partition wall portion 11 in the joint-side portion 13, the orifice 32 is provided in the orifice-side portion, so that the joint portion 19 and the orifice 32 are disposed in a position shifted from each other when viewed from a joint direction.

9 Claims, 6 Drawing Sheets

(56) References Cited

U.S. PATENT DOCUMENTS

| | | | | |
|---|---|---|---|---|
| 2007/0215128 | A1* | 9/2007 | Yonebayashi ..... | F01M 13/0416 123/572 |
| 2011/0179755 | A1* | 7/2011 | Gruhler ..... | B29C 65/58 55/320 |
| 2015/0052862 | A1* | 2/2015 | Wakabayashi ..... | B01D 50/002 55/462 |

FOREIGN PATENT DOCUMENTS

| | | | |
|---|---|---|---|
| JP | S62-10220 | U | 1/1987 |
| JP | H01-91013 | U | 6/1989 |
| JP | 2011-094507 | A | 5/2011 |
| JP | 2013-245597 | A | 12/2013 |
| JP | 2016-114035 | A | 6/2016 |
| WO | 2017/122724 | A1 | 7/2017 |

* cited by examiner

BLOW-BY GAS CONDUIT

RELATED APPLICATIONS

The present application is National Phase of International Application No. PCT/JP2018/027640 filed Jul. 24, 2018, and claims priority from Japanese Application No. 2017-153193, filed Aug. 8, 2017, the disclosure of which is hereby incorporated by reference herein in its entirety.

FIELD OF TECHNOLOGY

The present invention relates to a fluid conduit for allowing a fluid to flow therethrough.

BACKGROUND ART

In the fluid conduit, there is a fluid conduit wherein a fluid passage is partitioned by a partition wall so as to narrow a flow of the fluid by an orifice provided in the partition wall. For example, in Patent Document 1 (Japanese Unexamined Patent Application Publication No. 2016-114035), there is disclosed a device wherein in an oil separator provided in a vehicle such as an automobile and the like, the orifice is provided in the partition wall provided in a blow-by gas flow path, and a gas accelerated by the orifice is blown on a substrate provided facing the orifice so as to carry out an oil separation from a blow-by gas.

PRIOR ART DOCUMENT

Patent Document

Patent Document 1: Japanese Unexamined Patent Application Publication No. 2016-114035

SUMMARY OF THE INVENTION

Problems to be Solved by the Invention

In the device of the Patent Document 1, however, the partition wall is attached to the fluid conduit by the fitting using an attachment groove, so that airtightness (blocking of an upstream side and a downstream side of a flow path) by the partition wall is insufficient. On the other hand, in order to improve the airtightness of the partition wall, it is considered to carry out joining by vibration welding and the like; however, in that case, an adverse effect such as vibrations and the like at a welding time affects the orifice, and there is a possibility such that an accuracy of a size or a shape of the orifice is lowered.

The present invention is made in view of the aforementioned circumstances, and an object of the present invention is to provide a fluid conduit that can increase the airtightness by the partition wall in the fluid conduit allowing the fluid to flow therethrough, without lowering the accuracy of the size or the shape of the orifice provided in the partition wall.

Means for Solving the Problems

In order to obtain the aforementioned object, in the present invention, the following solution is adopted. Namely, as described in the invention, a fluid conduit wherein a fluid flows therethrough comprises a partition wall disposed in a flow path of the fluid, and joined to another member in a joint portion so as to partition the flow path of the fluid into an upstream side and a downstream side, and in the partition wall, there is provided an orifice narrowing a flow of the fluid, and the orifice is disposed in a position shifted from the joint portion relative to a joint direction in the joint portion.

According to the aforementioned solution, the orifice is disposed in the position shifted from the joint portion when viewed from the joint direction in the joint portion, so that at a time of joining the partition wall, an influence from the joint portion cannot reach the orifice. Therefore, a deformation and the like do not occur to the orifice even by a joining operation such as vibration welding and the like, and an accuracy of a size or a shape of the orifice can be assured with a high degree of accuracy.

The aforementioned partition wall may be joined by welding in the joint portion. In that case, by the welding (for example, the vibration welding), a highly airtight partition wall can be formed.

The orifice may be a portion having a smallest flow path cross-sectional area in a communication path communicating front and back of the partition wall. In that case, when the fluid (for example, a gas) flowing in the orifice is narrowed to be accelerated, a flow speed can be controlled with a high degree of accuracy by the orifice which does not have the deformation and the like.

The partition wall may be formed by joining a plurality of partition wall portions in the joint portion. In that case, the partition wall portions having various shapes can be combined so as to increase the degree of freedom in design including an arrangement of the orifice.

A main member of the fluid conduit is formed by combining a plurality of conduit portions, and each of the plurality of partition wall portions may extend from any one of the plurality of conduit portions. In that case, the partition wall portion extends from the conduit portion so as to increase the strength of the partition wall.

The partition wall comprises a joint-side portion where the joint portion is provided; and an orifice-side portion where the orifice is provided, and the orifice-side portion may be provided on the downstream side of the joint-side portion. In that case, by enlarging the joint-side portion, a width of the joint portion can be widened so as to appropriately carry out the joining such as the welding and the like. Also, by the orifice provided on the downstream side, the fluid can be accelerated so as to appropriately carry out, for example, a separation of an oil from a blow-by gas by an oil separator, and the like.

Effect of the Invention

According to the present invention, in forming the partition wall in the fluid conduit, an adverse effect that occurs on the orifice provided in the partition wall at the time of joining (for example, the welding) can be prevented so as to improve the accuracy of the size or the shape of the orifice.

BEST MODES OF CARRYING OUT THE INVENTION

Hereinafter, based on the attached drawings, an embodiment of the present invention will be explained.

Figure 1:
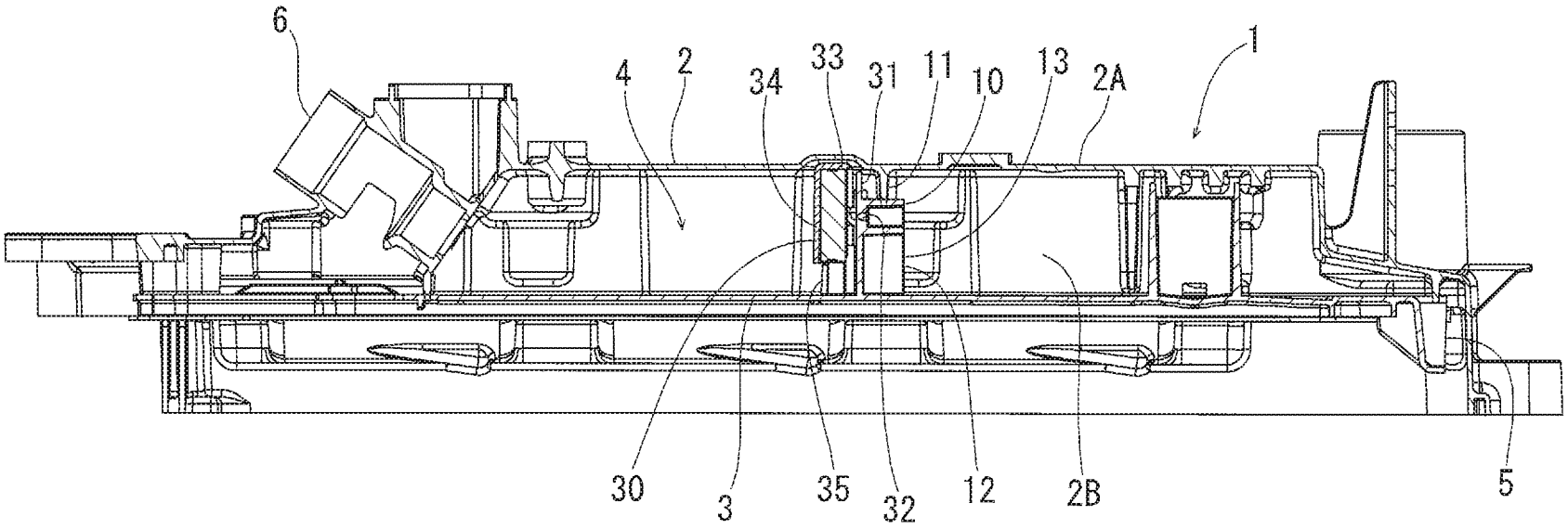
FIG. 1 is a cross-sectional view showing a blow-by gas conduit, wherein an oil separator is installed according to an embodiment of the present invention.
Figure 2:
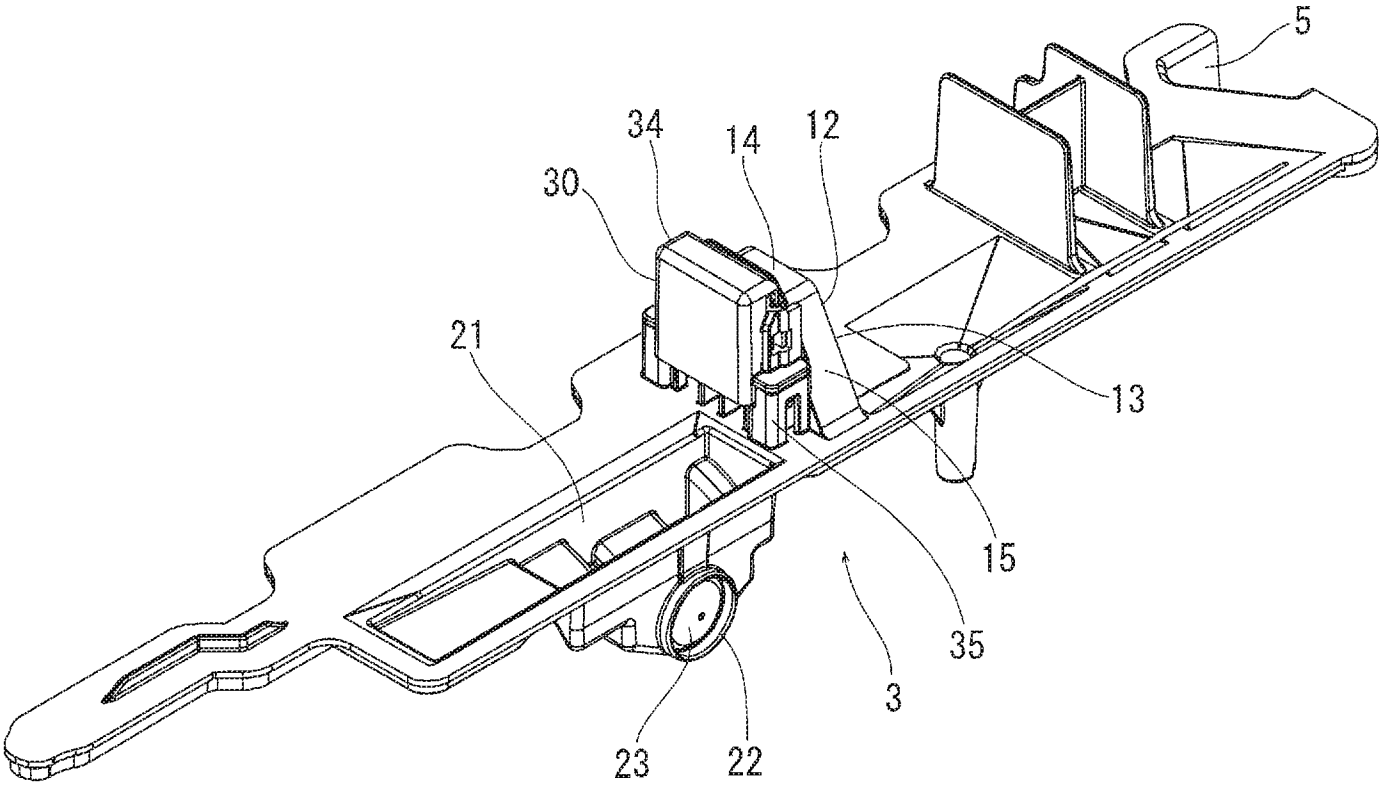
FIG. 2 is a perspective view showing a lower side member forming one portion of the blow-by gas conduit.
Figure 3:
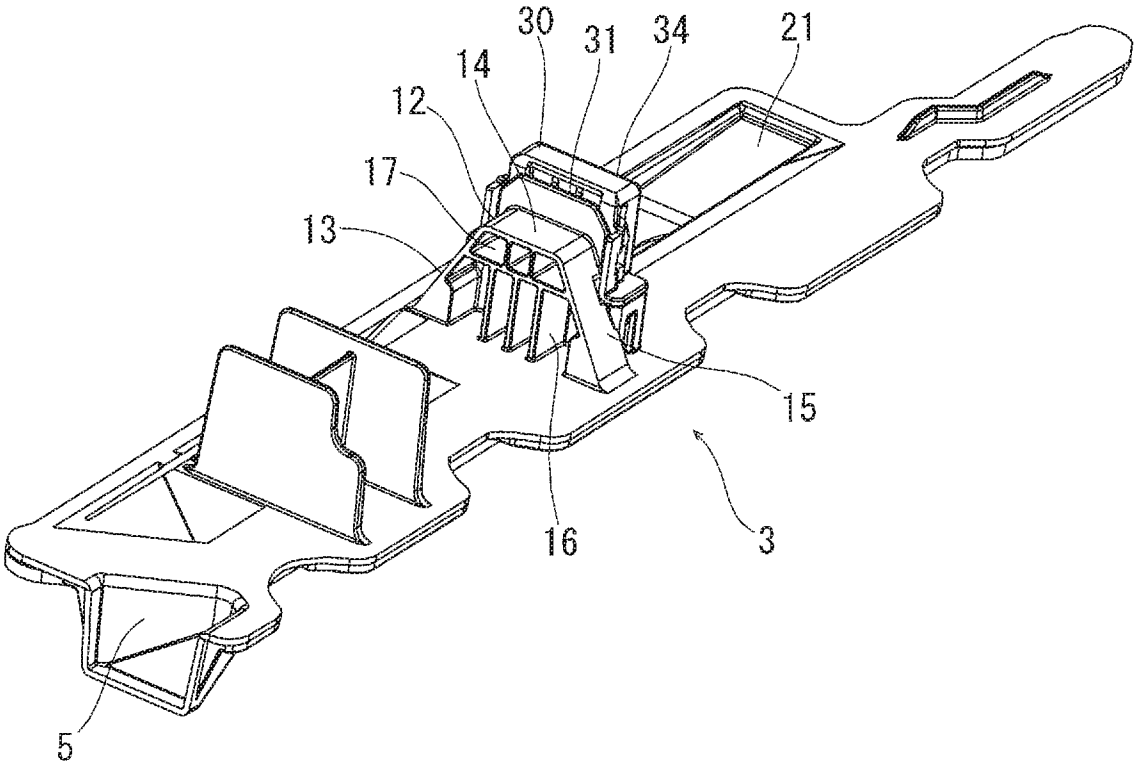
FIG. 3 is a perspective view showing the lower side member forming one portion of the blow-by gas conduit, and viewed from an opposite side.
Figure 4:
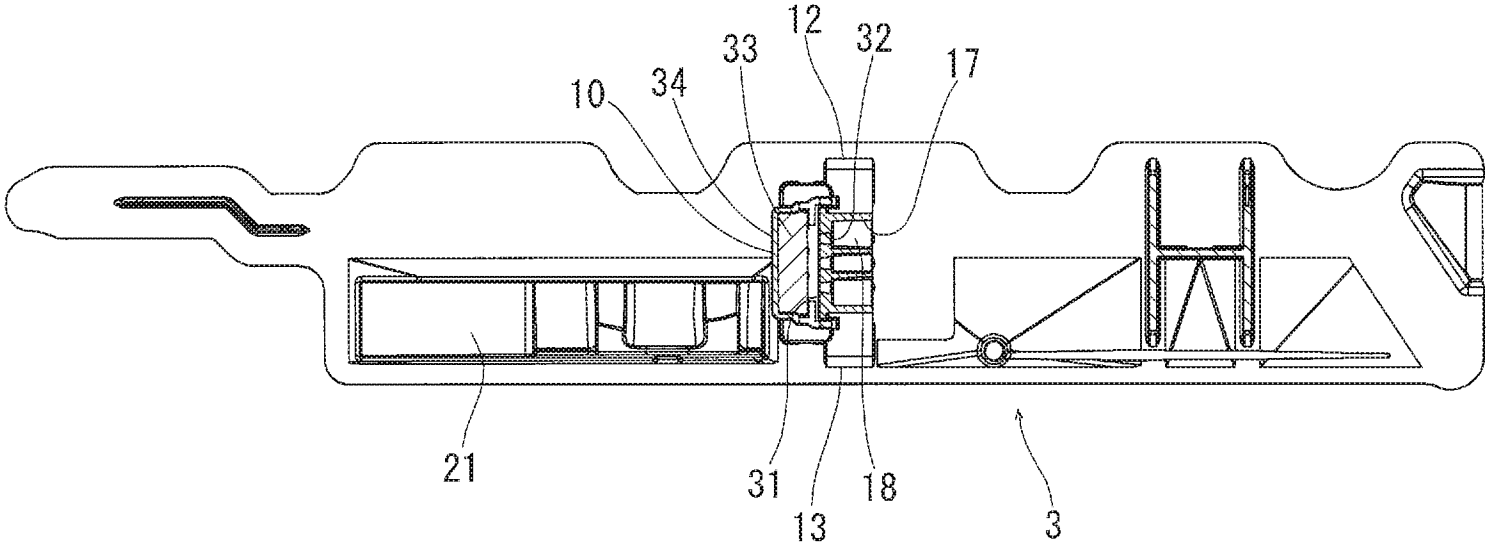
FIG. 4 is a plan view showing the lower side member forming one portion of the blow-by gas conduit.
Figure 5:
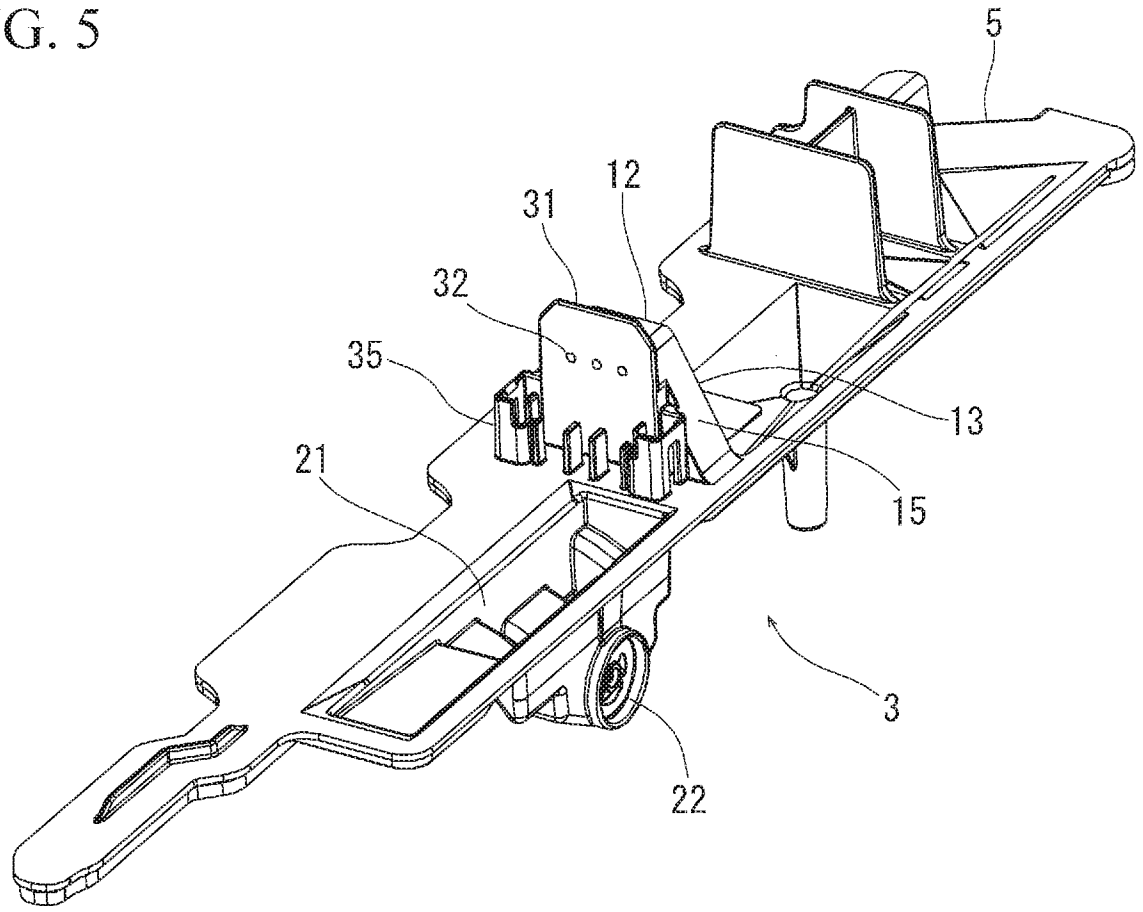
FIG. 5 is a perspective view showing the lower side member forming one portion of the blow-by gas conduit, and shows a state wherein one portion of the oil separator is removed.

FIG. 1 shows an overall structure of a fluid conduit 1 according to the embodiment of the present invention. As shown in the drawing, the fluid conduit 1 is formed by combining an upper side member 2 and a lower side member 3, and there is formed a fluid passage 4 in an area surrounded by both the members. In the present embodiment, the fluid conduit 1 is a blow-by gas conduit provided in an engine of a vehicle, and a blow-by gas (a gaseous body leaked from a combustion chamber of the engine) is introduced from an opening end portion 5 on an upstream side provided in the lower side member 3, and is discharged from an opening end portion 6 on a downstream side provided in the upper side member 2 through the fluid passage 4. Incidentally, the upper side member 2 is a member integrated with a head cover of the engine, and includes a ceiling wall 2A and side walls 2B on both sides.

In the vicinity of a middle of the fluid passage 4, there are disposed a partition wall 10 partitioning the fluid passage 4 into the upstream side and the downstream side, and an oil separator 30 provided adjacent to the partition wall 10. The partition wall 10 is formed by joining (vibration welding in the present embodiment) an upper-side partition wall portion 11 provided to extend toward an inside of the fluid passage 4 from the upper side member 2 and a lower-side partition wall portion 12 provided to extend toward the inside of the fluid passage 4 from the lower side member 3.

Figure 6:
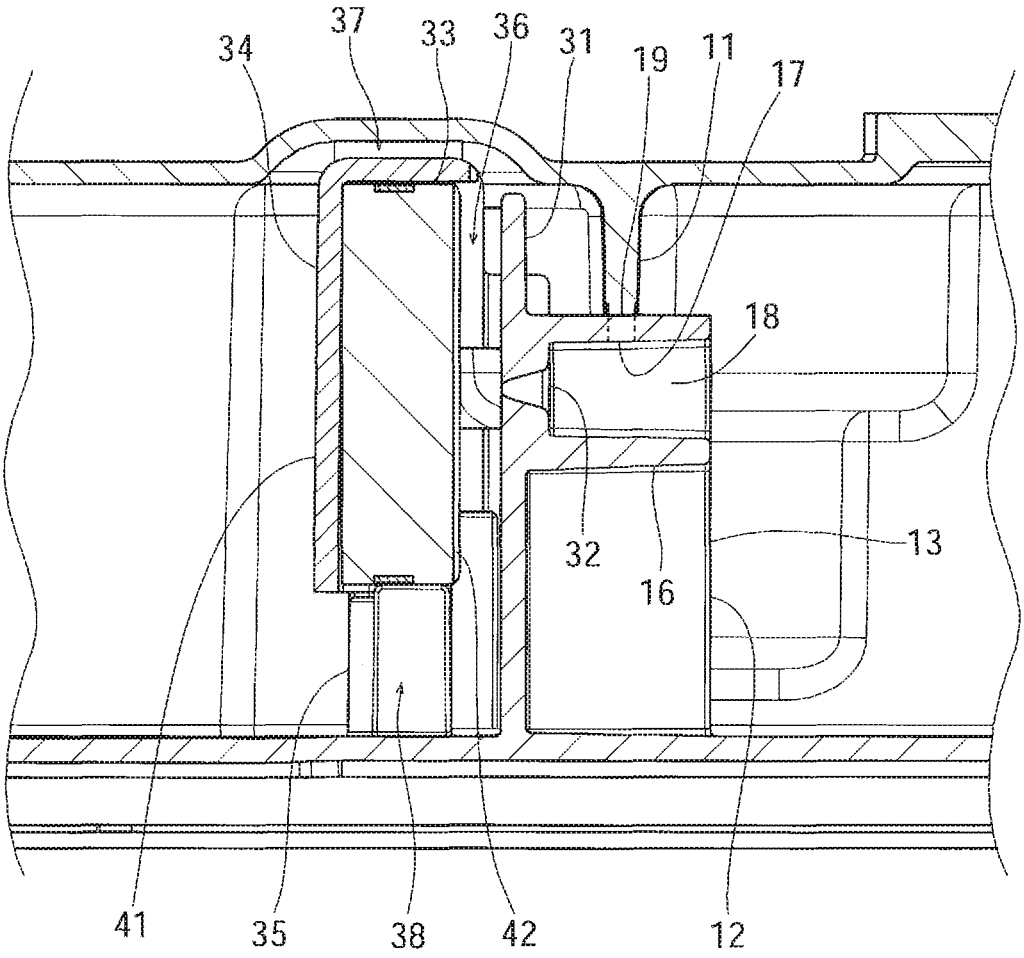
FIG. 6 is a longitudinal cross-sectional view showing one portion of the blow-by gas conduit.

In FIG. 2 to FIG. 5, the lower side member 3 is shown separately. Also, FIG. 6 shows an enlarged cross section near the partition wall 10 and the oil separator 30 of the fluid conduit 1. As shown in the drawings, the lower-side partition wall portion 12 comprises a joint-side portion 13 on the upstream side, and a wall portion 31 provided on the downstream side of the joint-side portion 13. Specifically, as described later, the wall portion 31 is a member wherein a plurality (three in the present embodiment) of orifices 32 which is an introduction hole of the gaseous body is formed, and the wall portion 31 forms one portion of the oil separator 30, and becomes an orifice-side portion of the partition wall 10.

The joint-side portion 13 is a portion joining to the upper-side partition wall portion 11, and comprises a ceiling wall 14 and side walls 15 on both sides. The side walls 15 on both sides extend obliquely downward from both sides of the ceiling wall 14, and have an approximately trapezoidal shape. Also, a plurality of reinforcement ribs 16 is provided inside the ceiling wall 14 and the side walls 15 on both sides.

In the vicinity of the ceiling wall 14 inside the joint-side portion 13, there is formed a plurality of (three in the present embodiment) joint-portion-side communication holes 17 as an area surrounded by one portion of the ceiling wall 14, the side walls 15, and the reinforcement ribs 16. The respective joint-portion-side communication holes 17 communicate with one corresponding orifice 32 of the wall portion 31, and by a whole joint-portion-side communication hole 17 and orifice 32, there is formed a communication hole 18 communicating the upstream side with the downstream side of the partition wall 10. An inner diameter (a flow path cross-sectional area) of the orifice 32 is smaller than an inner diameter of the joint-portion-side communication hole 17, and the orifice 32 becomes a portion having the smallest flow path cross-sectional area in the communication hole 18 (i.e. in a communication path communicating front and back of the partition wall 10), and furthermore, in a whole fluid conduit 1 (in a whole fluid passage where the blow-by gas inside the head cover flows). Thereby, a gas flowing in the communication hole 18 is narrowed in the orifice 32 so as to be accelerated and introduced to the downstream side.

A lower end portion of the upper-side partition wall portion 11 has a shape (a shape wherein the approximately trapezoidal shape is notched) matching an upper face (an outward face of the ceiling wall 14 and the side walls 15 on both sides) of the joint-side portion 13, and fits in the joint-side portion 13 from above. Thereby, the upper-side partition wall portion 11 and the lower-side partition wall portion 12 are joined (welded) to each other as an abutment portion between the upper-side partition wall portion 11 and the joint-side portion 13 as a joint portion 19.

Thus, according to the fluid conduit 1 of the present embodiment, the joint portion 19 for forming the partition wall 10 is provided in the joint-side portion 13 of the lower-side partition wall portion 12, and the orifice 32 is provided in the orifice-side portion (the wall portion 31) of the lower-side partition wall portion 12, so that the orifice 32 and the joint portion 19 are disposed (shifted in a right-and-left direction in FIG. 6) in a position shifted relative to a joint direction (an up-and-down direction in FIG. 6) of the upper-side partition wall portion 11 and the lower-side partition wall portion 12. Therefore, when the upper-side partition wall portion 11 and the lower-side partition wall portion 12 are joined (for example, at a time of the vibration welding), an influence of a force applied in the joint direction can be made difficult to reach the orifice 32. Thereby, a deformation and the like do not occur at the orifice 32, and a size and a shape of the orifice 32 can be assured with a high degree of accuracy. Also, in that case, joining by a joining method of the vibration welding and the like can be applied, so that the partition wall 10 can have high airtightness.

The oil separator 30 comprises the wall portion 31 which is an introduction portion for a gas; a separation member 33 for separating the gas from the gaseous body; and a holding portion 34 holding the separation member 33. The separation member 33 is a member made of a fiber material (for example, a non-woven fabric) in the present embodiment, and has a function such that a gas flow introduced from the orifice 32 of the wall portion 31 collides so as to separate an oil component from the gas.

The holding portion 34 is mounted on a mounting portion 35 provided on the downstream side of the wall portion 31, and is disposed in a predetermined position adjacent to the wall portion 31. Also, the holding portion 34 comprises a box-shaped main member portion 41 housing the separation member 33, and a positioning portion 42 provided on the upstream side of the main member portion 41 and holding the separation member 33 in the predetermined position. Thereby, a predetermined interval is accurately secured between the wall portion 31 and the separation member 33 (the positioning portion 42), and a separation chamber 36 is formed as a space having a certain size.

In an upper side and a lower side of the oil separator 30, there are respectively provided an upper-side outflow port 37 and a lower-side outflow port 38 for the gas. Thereby, the gas wherein an oil separation is carried out by the oil separator 30 goes round the upper side or the lower side of the oil separator 30, and flows into the downstream side mainly through the upper-side outflow port 37 or the lower-side outflow port 38. Incidentally, small holes are formed in right and left of the oil separator 30 as well, and one portion of the gas may flow into the downstream side from the right and left of the oil separator 30 as well.

In the lower side portion 2, there is formed an oil storage portion 21 in such a way so as to be positioned on the downstream side of the oil separator 30, and the oil separated by the oil separator 30 flows in. In the oil storage portion 21, there is provided an outlet 22, and in the outlet 22, there is installed a drain valve 23. Thereby, the oil stored in the oil storage portion 21 is drained from the outlet 22 as needed by opening the drain valve 23. Incidentally, in the oil storage portion 21, a lid member (not shown in the drawings) may be provided as well.

The embodiment of the present invention has been explained above; however, the present invention is not limited to the aforementioned embodiment, and can be changed accordingly within a range described in the invention. For example, in the aforementioned embodiment, the partition wall 10 is formed by joining the upper-side partition wall portion 11 and the lower-side partition wall portion 12; however, the present invention is not limited to the aforementioned embodiment, and, for example, the partition wall may be formed by joining a partition wall portion relative to an inner face of a conduit main member as well.

INDUSTRIAL APPLICABILITY

The present invention can be used for a blow-by gas conduit in a vehicle engine, and the like.

EXPLANATION OF SYMBOLS

1 a fluid conduit
2 an upper side member
3 a lower side member
4 a fluid passage
5 an opening end portion
6 an opening end portion
10 a partition wall
11 an upper-side partition wall portion
12 a lower-side partition wall portion
13 a joint-side portion
14 a ceiling wall of the joint-side portion
15 side walls of the joint-side portion
16 reinforcement ribs of the joint-side portion
17 joint-portion-side communication holes
18 communication holes
19 a joint portion
30 an oil separator
31 an wall portion (an orifice-side portion)
32 orifices
33 a separation member
34 a holding portion
35 a mounting portion
36 a separation chamber
37 an upper-side outflow port
38 a lower-side outflow port
41 a main member portion of the holding portion
42 a positioning portion of the holding portion

What is claimed is:

1. A blow-by gas conduit where a fluid flows, comprising:

an upper side member and a lower side member, extending in a direction of a flow path of the fluid and connected to each other; and a partition wall partitioning the flow path of the fluid into an upstream side and a downstream side, and including an upper-side partition wall portion extending from the upper side member, a lower-side partition wall portion extending from the lower side member and joined to the upper-side partition wall portion at a joint portion, wherein the partition wall includes an orifice narrowing a flow of the fluid, and the orifice is disposed in a position shifted from the joint portion relative to a joint direction of the joint portion.

2. A blow-by gas conduit according to claim 1, wherein the upper-side partition wall portion and the lower-side partition wall portion are joined by welding at the joint portion.

3. A blow-by gas conduit according to claim 1, wherein the orifice is a portion having a smallest flow path cross-sectional area in a communication path communicating front and back of the partition wall.

4. A blow-by gas conduit according to claim 1, wherein the partition wall further includes at least one partition wall portion, and is formed by joining the upper-side partition wall portion, the lower-side partition wall portion, and the at least one partition wall portion at the joint portion.

5. A blow-by gas conduit according to claim 4, further comprising at least one member disposed between the upper side member and the lower side member, wherein the upper side member and the lower side member are connected through the at least one member, and each of the upper-side partition wall portion, the lower-side partition wall portion, and the at least one partition wall portion extends from any one of the upper side member, the lower side member, and the at least one member.

6. A blow-by gas conduit according to claim 1, wherein one of the upper-side partition wall portion and the lower-side partition wall portion includes a joint-side portion where the joint portion is provided and an orifice-side portion where the orifice is provided, and the orifice-side portion is provided on a downstream side of the joint-side portion.

7. A blow-by gas conduit according to claim 6, wherein the upper-side partition wall portion is integrally formed with the upper side member as one member, and the lower-side partition wall portion is integrally formed with the lower side member as another member, the joint-side portion includes a ceiling wall portion extending from the orifice-side portion in the direction of the flow path of the fluid and joined to another of the upper-side partition wall portion and the lower-side partition wall portion at the joint portion on the ceiling wall portion, and the orifice is formed in the orifice-side portion and is disposed apart from the joint portion of the ceiling wall portion in the direction of the flow path of the fluid.

8. A blow-by gas conduit according to claim 7, wherein the lower-side partition wall portion includes the joint-side portion and the orifice-side portion, and the joint-side portion further includes side wall portions extending downwardly from two sides of the ceiling wall portion to the lower side member, and a plurality of reinforcement ribs partitioning a space inside the ceiling wall portion and the side wall portions into communication holes communicated with the orifice.

9. A blow-by gas conduit according to claim 8, further comprising an oil separator disposed at a downstream side of the orifice-side portion and including a separation member, a holding portion holding the separation member thereinside, and a mounting portion mounting the holding portion thereon, wherein the holding portion includes a main member portion in which the separation member is stored, and a positioning portion disposed at an upstream side of the main member portion to position the separation member at a predetermined position, and the mounting portion is disposed between the lower side member and the holding portion and includes a hole through which a gas separated by the oil separator flows toward a downstream side of the blow-by gas conduit.

* * * * *